US006969121B2

(12) United States Patent
Drajan

(10) Patent No.: US 6,969,121 B2
(45) Date of Patent: Nov. 29, 2005

(54) CHAIR CONSTRUCTION

(76) Inventor: Cornell Drajan, 976 Spicer Cove Rd., Hendersonville, NC (US) 28792

( * ) Notice: Subject to any disclaimer, the term of this patent is extended or adjusted under 35 U.S.C. 154(b) by 31 days.

(21) Appl. No.: 10/784,921

(22) Filed: Feb. 24, 2004

(65) Prior Publication Data

US 2005/0023879 A1 Feb. 3, 2005

Related U.S. Application Data

(60) Provisional application No. 60/448,895, filed on Feb. 24, 2003.

(51) Int. Cl.[7] ..... A47C 7/00
(52) U.S. Cl. ..... 297/440.2
(58) Field of Search ..... 297/440.1, 440.2, 297/440.21, 440.22, 452.14

(56) References Cited

U.S. PATENT DOCUMENTS

| | | | | | |
|---|---|---|---|---|---|
| 3,861,747 | A * | 1/1975 | Diamond | 297/452.49 |
| 5,064,247 | A * | 11/1991 | Clark et al. | 297/440.22 |
| 5,110,186 | A * | 5/1992 | Clark et al. | 297/440.2 |
| 5,779,317 | A * | 7/1998 | Neal | 297/440.2 |
| 5,842,264 | A * | 12/1998 | Roossien et al. | 297/440.22 |
| 6,135,562 | A * | 10/2000 | Infanti | 297/440.2 |
| 6,305,750 | B1 * | 10/2001 | Buono et al. | 297/440.2 |
| 6,637,823 | B1 * | 10/2003 | Ursini et al. | 297/440.2 |

* cited by examiner

*Primary Examiner*—Peter R. Brown
(74) *Attorney, Agent, or Firm*—Shoemaker and Mattare

(57) ABSTRACT

A chair has a seat back with removable front and rear upholstered covers. The covers are held to the back by hidden release levers which prevent unauthorized removal of the covers.

7 Claims, 2 Drawing Sheets

CHAIR CONSTRUCTION

This application claims priority from provisional patent application 60/448,895, filed Feb. 24, 2003.

BACKGROUND OF THE INVENTION

This invention relates to a chair construction. There are prior constructions in which parts of the chair are removable, to facilitate assembly and to permit repair or replacement of cushions and upholstery. A disadvantage of many such constructions is that they may be disassembled by curious users who are not authorized to do so. Also, such constructions may have conspicuous protruding release mechanisms which detract from the appearance of the chair, and may be dangerous.

SUMMARY OF THE INVENTION

An object of the invention is provide a chair which can be assembled and disassembled readily through a mechanism which is not apparent to the casual observer.

Another object is to improve the appearance of such a chair.

A further object is to improve the safety of a chair of the type described.

These and other objects are attained by a chair construction as described below.

BRIEF DESCRIPTION OF THE DRAWINGS

In the accompanying drawings.

DESCRIPTION OF THE PREFERRED EMBODIMENT

Figure 1:
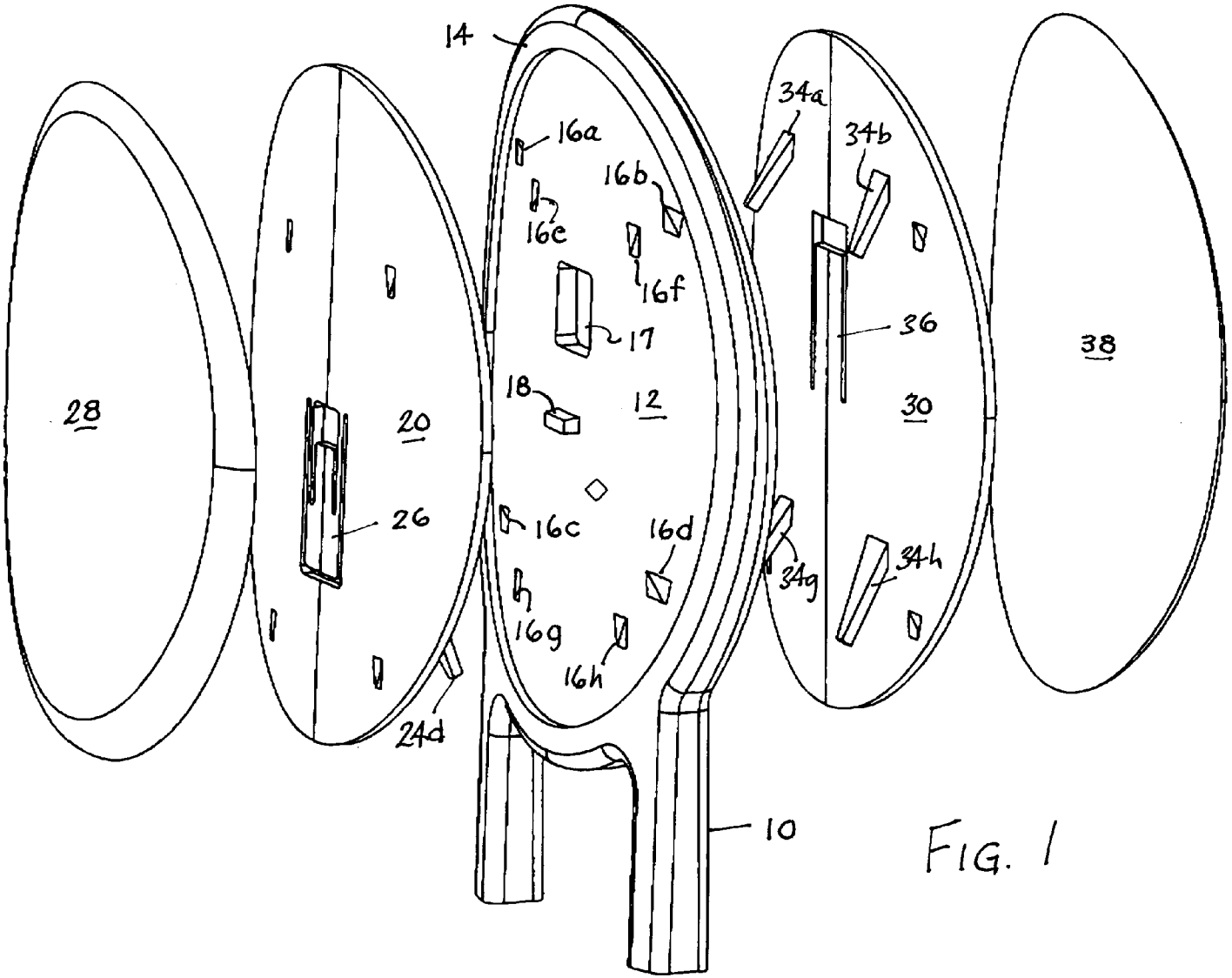
FIG. 1 is an exploded perspective view of the rear of a seat back embodying the invention.
Figure 2:
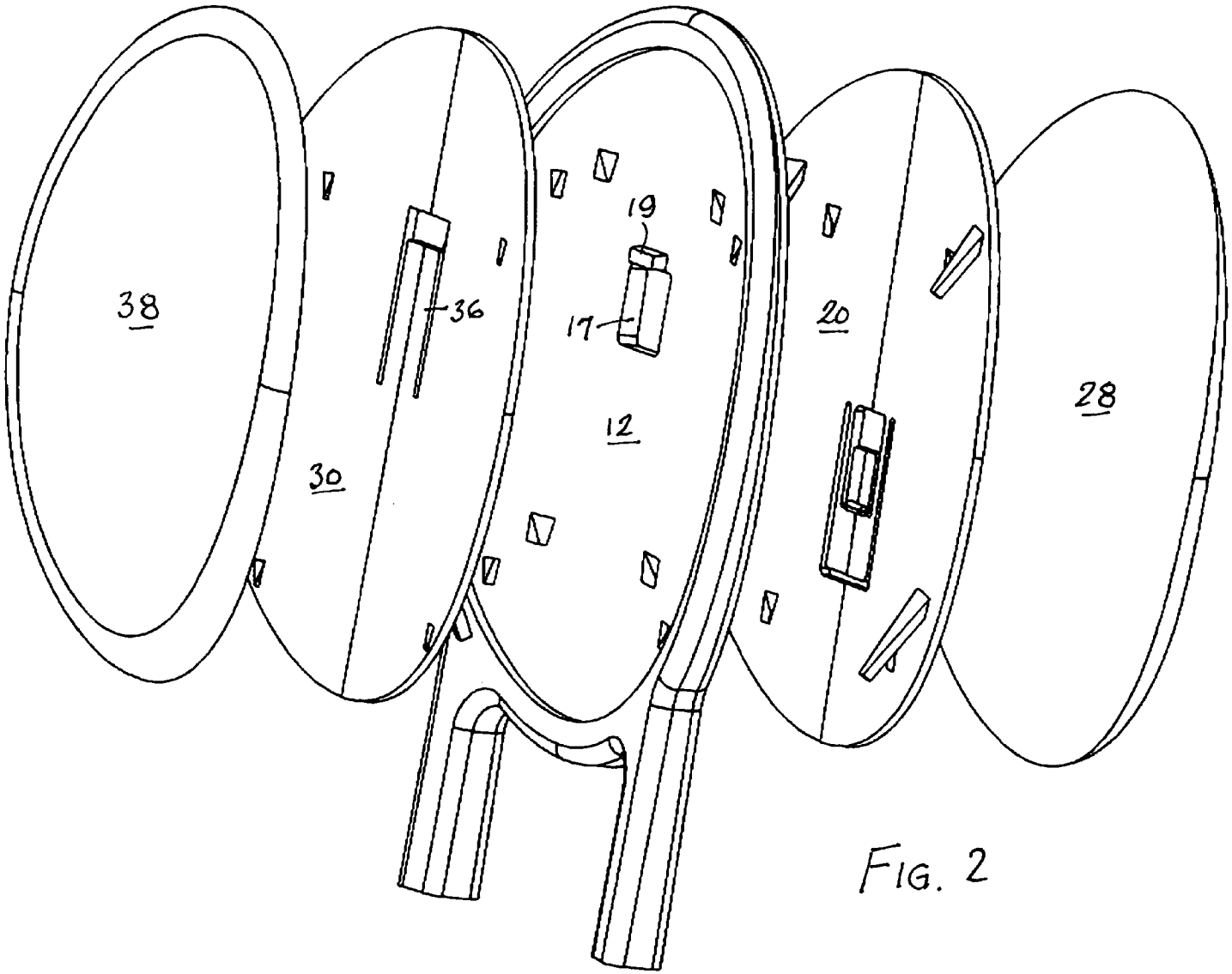
FIG. 2 is an exploded view of the front thereof.

A chair embodying the invention includes a seat back having a frame 10 comprising a fixed plate 12 bounded by a periphery 14, only the periphery being visible when the chair is assembled. The fixed plate 12 has four pairs of diagonal holes or apertures 16*a*–16*h*. There is a window 17 near the center. Integral blocks 18, 19 protrude from the rear and front surfaces respectively of the frame plate. Block 18 is below the window and block 19 is above the window.

Removable upholstered covers 20, 30 are attached to the front and rear surfaces of the frame plate. The rear cover 20 includes a rear cover plate 22 having four generally parallel upper and lower fingers 24*a*–24*d* extending from its forward surface. Preferably, the fingers are molded integrally with the rear cover plate, but they could be made separately, in which case they would be attached by suitable fasteners or adhesive. The fingers extend diagonally forward and downward from the rear cover plate at an angle of 20° to 45°. They slide into the correspondingly angled apertures 16*a*–16*d* in the fixed plate when the rear assembly is being attached to the frame. As the parts near their assembled position, a release lever 26, which is formed integrally with the rear plate, deforms resiliently as it rides over a block 18. When the tip 18*a* of the lever clears the block, it snaps behind the block, locking the rear cover plate to the fixed plate by preventing reverse movement.

The rear cover plate 20 is concealed by a soft ornamental material 28, such as foam, fabric, leather, or synthetic material, which is attached to the rear cover plate 20 by glue, staples, or other suitable means. The fabric hides the connecting mechanism, particularly the release lever 26, so that it is not evident how to disassemble the chair.

To release the rear cover plate from the frame, one presses through the material 28 against the bottom 26*a* of the release lever 26. This of course requires knowledge of where the lever is located. When pressed, the lever pivots around the fulcrum 26*b*, disengaging the forward tip 26*c* from the block 18, whereupon the rear cover plate can be removed from the frame.

The front cover 30 similarly has a front cover plate with obliquely extending fingers 34*e*–34*h*, which are received in the frame apertures 16*e*–16*h*. An integral cantilever spring clip 36 snaps behind the block 19 on the front surface of the frame plate when the cover is installed on the frame.

The front cover 30 can be released from the frame plate only after the back plate has been removed. This is accomplished by pressing forward on the clip 36, though the window 17, to disengage the block 19, whereafter the front plate can be lifted diagonally upward out of contact with the frame.

While the structure described above is directed to the seat back, the same principles could be applied to construct a seat bottom as well.

Since the invention is subject to modifications and variations, it is intended that the foregoing description and the accompanying drawings shall be interpreted as only illustrative of the invention defined by the following claims.

I claim:

1. A chair comprising a chair back or seat comprising a fixed plate having a front surface and a rear surface, four pairs of apertures extending diagonally through the fixed plate, and a central window, a first block protruding from the rear surface of the fixed plate, below the window, a second block protruding from the front surface of the fixed plate, above the window, a removable front upholstered assembly attached to the front surface of the fixed plate, a removable rear upholstered cover attached to the rear surface of the fixed plate, the rear cover including a rear cover plate having four generally parallel upper and lower fingers extending diagonally downward and forward from its forward surface.

2. The invention of claim 1, wherein the fingers are molded integrally with the rear cover plate.

3. The invention of claim 1, wherein the fingers are attached to the rear cover plate by suitable fasteners or adhesive.

4. The invention of claim 1, wherein the fingers meet the rear cover plate at an angle of 20° to 45°.

5. The invention of claim 1, further comprising a release lever having a tip which is movable between a locking position engaging the block to prevent removal of the rear cover plate, and a release position disengaged from the block and permitting the rear cover plate to be removed.

6. The invention of claim 1, further comprising an ornamental material attached to the rear cover plate, the material concealing the connecting mechanism so that it is not evident how to disassemble the chair, yet being sufficiently soft that one can release the clip by pressing on the clip through the material.

7. The invention of claim 1, further comprising a front cover having obliquely extending fingers which are inserted through the frame apertures, and a cantilever spring clip which during assembly snaps behind the second block, whereby the front cover plate can be released from the frame plate after the rear cover plate has been removed by pressing forward on the clip, though the window, to disengage the second block.

* * * * *